US009688367B2

(12) United States Patent
Strong

(10) Patent No.: US 9,688,367 B2
(45) **Date of Patent: *Jun. 27, 2017**

(54) TOWING ROPE FOR WATER SKIING

(71) Applicant: Jared Strong, San Diego, CA (US)

(72) Inventor: Jared Strong, San Diego, CA (US)

( * ) Notice: Subject to any disclaimer, the term of this patent is extended or adjusted under 35 U.S.C. 154(b) by 385 days.

This patent is subject to a terminal disclaimer.

(21) Appl. No.: 13/712,822

(22) Filed: Dec. 12, 2012

(65) Prior Publication Data

US 2014/0158036 A1 Jun. 12, 2014
US 2017/0066509 A9 Mar. 9, 2017

Related U.S. Application Data

(63) Continuation-in-part of application No. 13/015,460, filed on Jan. 27, 2011, now Pat. No. 8,499,711.

(60) Provisional application No. 61/298,867, filed on Jan. 27, 2010.

(51) Int. Cl.

| | |
|---|---|
| ***B63B 21/56*** | (2006.01) |
| ***B63B 35/85*** | (2006.01) |
| ***B63B 35/81*** | (2006.01) |
| *B63B 35/73* | (2006.01) |

(52) U.S. Cl.

CPC ..... *B63B 35/815* (2013.01); *B63B 2035/735* (2013.01); *B63B 2035/818* (2013.01)

(58) Field of Classification Search

CPC ..... B63B 35/815; B63B 35/816; B63B 21/66; B63B 21/56; G01V 1/3826

USPC ..... 441/68, 69, 70, 73; 114/253; 440/33

See application file for complete search history.

(56) References Cited

U.S. PATENT DOCUMENTS

| | | | | |
|---|---|---|---|---|
| 2,946,305 | A * | 7/1960 | Hill | 114/253 |
| 3,142,075 | A * | 7/1964 | Hill | 441/73 |
| 4,069,786 | A * | 1/1978 | La Botz | 441/69 |
| 4,606,728 | A * | 8/1986 | Simpson | 441/66 |
| 5,009,183 | A * | 4/1991 | Naypaver | 114/253 |
| 5,083,955 | A * | 1/1992 | Echols | 441/65 |
| 2011/0179987 | A1 * | 7/2011 | Strong et al. | 114/253 |

* cited by examiner

*Primary Examiner* — Anthony Wiest
(74) *Attorney, Agent, or Firm* — Donn K. Harms

(57) ABSTRACT

A tow rope engagement system for a water ski or wakeboard or configured to communicate a majority of the force from the boat engaged to the tow rope, directly to the water ski or wakeboard during deep water starts by a rider. The lesser force required to ride is transferred to a handle held by the skiers hands once the skier has reached a substantially standing position and is on top of the water. A quick release is provided which will disconnect the tow rope should the rider activate it manually or by falling.

23 Claims, 7 Drawing Sheets

TOWING ROPE FOR WATER SKIING

This application is a Continuation in Part of U.S. application Ser. No. 13/015,460 filed on Jan. 27, 2011 which claims priority to U.S. Provisional Patent Application Ser. No. 61/298,867 filed on Jan. 27, 2010, both incorporated herein in their respective entirety by reference thereto.

BACKGROUND OF THE INVENTION

1. Field of the Invention

This invention relates generally to water skis and wakeboards. More particularly the disclosed device and method relate to an improved tow rope ski and wakeboard engagement system for pulling a rider, which is configured to lessen the force imparted to the hands and arms of a user in a deep water start. Through the communication of a substantial portion of the force from the boat pulling up a rider, directly to the water ski or wakeboard, deep water starts are made considerably easier for both novice and experienced skiers.

2. Prior Art

Water skiing, and more recently wakeboarding, are particularly popular boating sports. In the sport of water skiing, participants may employ one or two skis depending on their skill level, conventionally with their feet oriented in a forward position parallel with the length of the ski. In wakeboarding, the user employs a single board having their feet oriented perpendicular to the length of the board similar to other board sports such as skateboarding, surfing, and snowboarding. For participants employing either skis or a wakeboard, an inherent problem exists. Consistently problematic to all ski and wakeboard users is the step of employing a boat with a trailing tow rope held by the user, to pull the user from a floating position in the water rearward of the boat. The user with their body substantially submerged in the water, must be pulled forward at a sufficient speed to impart a lift to the ski or board, to allow the user to achieve a hydroplaning position standing on the ski or board. Once sufficient speed is generated to impart the lift to the ski or board, both user and ski or board are propelled upon the water surface while being towed behind the speeding boat.

For participants employing a single ski, as opposed to two skis, additional difficulty is incurred during such deep water starts. While submerged to their chest or neck, with the ski engaged to their feet, the skier must hold the tip of the ski above the water's surface. Additionally, the skier must be able to endure the difficulty of retaining their grip on the tow rope handle, and concurrently their balance, as the considerable force of the moving boat is communicated to the handle of the rope during a take off. In this submerged position the skier is essentially an anchor until they are able to move forward at sufficient speed to impart sufficient lift, to ride on top of the water.

For participants employing a wakeboard, similar and additional difficulties are also incurred during such deep water starts. Unlike skiing wherein the user sits in the water already oriented in the direction of which they will be skiing, the wakeboarder is submerged in a sitting position holding the toe side edge of the board above the water's surface. As such, during the take off and while enduring the force of the tow rope, the user must make a 90 degree turn as they are pulled out of the water to a standing position. This requires a considerable amount of balance, strength, and skill.

During such a deep water start, a substantial amount of force must be endured by the user's grip on the handle to pull them forward to a hydroplaning speed. For heavy or large users, this force is multiplied since they offer more resistance while in the water, and they must reach a higher speed before they rise above the water.

One conventional method to assist a skier or wakeboarder in getting into an upright standing position on the moving ski or board, is to simply have the user take off from shore while they are already standing and holding the rope with tension on the tow rope. While this shore-start, or pier-start, eliminates the duration of extreme force communicated to a submerged user to reach a velocity sufficient to lift a skier or wakeboarder from a floating position, it has other associated problems. First, if the shore-starting skier or wakeboarder falls, they must be taken back to the shallow water on shore which is hazardous to both boat and propeller. Additionally, the force exerted on the shore-starting skiers arms and shoulders and hands can be extreme, especially if the rope is not initially taught. This excessive force can cause injury, since the boat generally starts moving before the tow rope is made taught.

Because of the difficulty of holding onto the tow rope during such starts, many novice skiers and wakeboarders fail and many experienced users become exhausted from simply getting to the skiing position. Further, it is a waste of valuable water-time to continually return and retry to pull a skier after a previous attempt to launch, especially if there are others waiting to ski.

An example of prior art may be seen in U.S. Pat. No. 4,606,728 which notes the various problems inherent to a deep water start of a skier. As a remedy, this patent teaches a water ski aid in deep water starts in which a user is seated on an inflatable member. As noted, this allows the user to start in a position more favorable to attaining an upright skiing position prior to take off. However, this method involves the use of extraneous equipment.

As such, there is a continuing unmet need for a device and method which will provide assistance to a water skier and wakeboarder attempting a deep water start so as to move from the floating starting position, to an upright standing position on the moving ski or wakeboard. Such a device should significantly reduce the amount of force imparted to the skier's hands and thereby make it easier for novice and experienced skiers to hold the tow rope during a deep water start. Such a device in communicating force directly to the aquatic sports equipment such as a ski or wakeboard will thereby allow the user to concentrate on balancing rather than holding on to the handle. Still further, such a device should be configured for use with the current installed base of conventionally employed tow ropes and ski boats to encourage widespread use. Finally, such a device should provide for an automatic release from the towing boat, should the user fall or fail to negotiate the positioning change from floating to standing during a deep water or other start.

In this respect, before explaining at least one embodiment of the improved ski tow rope apparatus and method herein in detail, it is to be understood that the invention is not limited in its application to the details of construction and to the arrangement of the components set forth in the following description or illustrated in the drawings nor the steps and components outlined in the specification. The invention is capable of other embodiments and of being practiced and carried out in various ways as those skilled in the art will readily and immediately ascertain upon being educated by reading this application. Also, it is to be understood that the phraseology and terminology employed herein are for the purpose of description and should not be regarded as limiting.

As such, those skilled in the art will appreciate that the conception upon which this disclosure is based may readily be utilized as a basis for designing other methods and systems for carrying out the several purposes of the present invention which is a significant improvement to conventionally employed water skiing tow ropes and skis. It is important, therefore, that the claims be regarded as including such equivalent construction insofar as they do not depart from the spirit and scope of the present invention.

SUMMARY OF THE INVENTION

The device and method herein provides a solution to the above noted shortcomings in the prior art of tow ropes and the extreme force which must conventionally be endured by water skiers during deep water and other starts. The device and method provide a user with a means to directly communicate the substantial force of the tow rope which is communicated from the moving boat, directly to the water-ski or wakeboard. Briefly, it is noted that the term 'skier' is employed to reference both a user of water skis as well as a wakeboard.

The device herein removes the need for the skier to hold the handle and resist such a high force with only their hands during the initial act of moving from deep water or a nonmoving position to a standing position on a forward-moving water ski or wakeboard. In doing so, the device will enable novices to more easily learn to ski and wakeboard, and will prevent exhaustion for experienced skiers especially those who might be heavier.

As disclosed, particularly preferred modes of the device employed for water skis and wakeboards include a docking component configured for a removable direct attachment of a tow rope to the water ski or wakeboard. The tow rope employs a handle communicating with a main tow line, a split line communicating from the main tow line having an engaging end, and preferably a safety release line adapted to disengage the rope from the ski or wakeboard. For modes of the device employed with wakeboarding, it is preferred that the split line is instead comprised of a single line extending to the engaging end, described below. This combination of components is employed while the skier is confronted with a deep water start during waterskiing and wakeboarding.

In such a conventional deep water start, while the skier is floating in the water, they use their hands to grip and hold onto the handle which is communicating with rope with the main line of the tow rope which leads from the handle to an attachment point with the main line which has an opposite or distal end which engages with the towing boat.

For the water skiing mode, the split line also leads from a main attachment point with the main line of the tow rope to an engagement end. The engagement end of the split line is configured for a removable engagement directly to the ski itself. This removable engagement is provided by a docking component on the ski adapted to engage a docking member on the two respective ends of the two portions of the split line. The two portions of the split line are engaged to respective ends of the docking member so as to extend at an angle such that they maintain a position positioned on each side of the ski when the skier is submerged and rising from the water.

For the mode of the device employed for wakeboarding, the single line as opposed to a split line also leads from a main attachment point with the main line of the tow rope to an engagement end configured for a removable engagement directly to the wakeboard. It is noted that the operative employment of the modes of the device for single skis, pair of skis, and wakeboarding, are substantially similar, however, the docking members and docking component configurations, locations and orientations are slightly modified as needed, as will be described in the detailed description shortly below.

For the skiing mode, the docking member is adapted for removable engagement when placed into the docking station from a direction substantially perpendicular to the planar top surface of the ski. In the wakeboarding mode, the docking station is disposed at or near the toe side edge of the board at a location between the users feet. In both modes, this allows the force of the tow rope to be imparted to the docking station yet allows for quick insertion and removal of the docking member if pulled away from the ski or board at a perpendicular direction.

The docking component may be engaged with the ski using a means of engagement adapted to the task to position it just forward of the front boot which provides a removable engagement to the foot of the skier with the ski. This docking component in the mode of the device for a single ski use, in combination with the docking member, maintains an angled widening gap between the two portions of the split line communicating between the docking member and the main line. This gap provides a means to maintain both portions of the split line adjacent to the outside edges of the front end of the ski during a start.

The length of the two portions of the split line are sufficiently short so as to allow for a sufficient amount of slack to be maintained in the handle line communicating between the main line and the engagement point, during a take off. This allows the force communicated by the moving boat to be directly communicated to the ski, and not to the hands of the skier who may concentrate on balancing and getting up.

In use, as the towing vessel takes off and moves away from the skier, and communicates force through the tow rope to the skier so they may reach a speed to impart lift to the ski to raise both from the water, the docking component and docking member are configured to impart the force to the ski for a period of time and then allow the docking member to slip out of its engagement with the docking component. Upon this disengagement, the tension from the force of the boat communicated through the tow rope is redirected to the handle line and handle which is in the user's grip. However, by this time the skier has reached sufficient velocity that the torque pulling the handle is minimal.

With the substantial initial force from the boat movement being directed to both portions of the split line to the board-mounted docking component, much less grip strength is required by the skier to rise from deep water or other starts. Thus, be they a novice or experienced, they are no longer fatigued during the take off process and can maintain their strength and grip and balance much longer once the upright skiing position is reached. Further, for user's heretofore incapable of holding the handle during a take off from deep water, which is an especially vexing problem for large or heavy skiers, the disclosed device allows such users to rise to the riding position by communicating force to the ski rather then their hands.

Safety is enhanced by the device should a user fail to completely reach the upright skiing position, causing a fall during the take off process while both the rope and ski are being pulled by great force. To ensure that the engagement member does not maintain its engagement at the docking component on the ski or board (causing the user to be dragged behind the boat), in all modes of the device a quick release component is provided between both the handle line and the split line or single line and the main line of the tow rope. This quick release component is engaged to a safety line which follows a path to a ring or handle positioned adjacent to the handle held by the skier. In case of a fall, or if the user gets tired during skiing, the user may simply tug the safety line which translates a collar on the quick release causing a release of the tow rope from both the split line and handle line. This allows the user an active means to release the force of the boat from the ski should the passive release of the docking member from the docking component fail.

With respect to the above description, it is to be understood that the invention is not limited in its application to the details of operation of aiding a user to water ski and wakeboard, or a quick release of a skier from a tow rope, nor the arrangement of the components or steps in the method set forth above or in the following descriptions or in the illustrations in the drawings. The various methods of implementation and operation of the disclosed method and device used to aid in water skiing herein, are capable of other embodiments and of being practiced and carried out in various ways which will be obvious to those skilled in the art once they review this disclosure.

Therefor, those skilled in the art will appreciate that the conception upon which this disclosure is based may readily be utilized as a basis for designing similar water ski devices or methods for carrying out the several purposes of the present invention. Therefor, the objects and claims following herein should be regarded as including such equivalent constructions, steps, and methodology insofar as they do not depart from the spirit and scope of the present invention.

It is an object of this invention to assist a towed water skier or wakeboarder to achieve an upright skiing position starting from a stagnate floating position.

It is another object of this invention to communicate the initial force or torque communicated to a skier by a boat on the tow rope during a take off, away from the users grip, and directly to the ski itself to thereby reduce the fatigue caused by high forces required to lift a water skier out of the water.

It is yet another object of this invention to allow the user to safely release themselves and the ski from the towing rope in the case of a fall, or to keep from being dragged behind the boat.

Yet an additional object of the invention is to provide a device which will allow skiers, heretofore incapable of holding the tow rope handle for sufficient time during deep water starts, to move from submersion to riding the ski, a means to do so.

These together with other objects and advantages of the improved engagement of a ski rope to a ski which will become subsequently apparent to those skilled in the art, reside in the details of the construction and method herein as more fully hereinafter described and claimed, reference being had to the accompanying drawings forming a part thereof, wherein like numerals refer to like parts throughout.

DETAILED DESCRIPTION OF THE PREFERRED

Embodiments of the Invention

Figure 1:
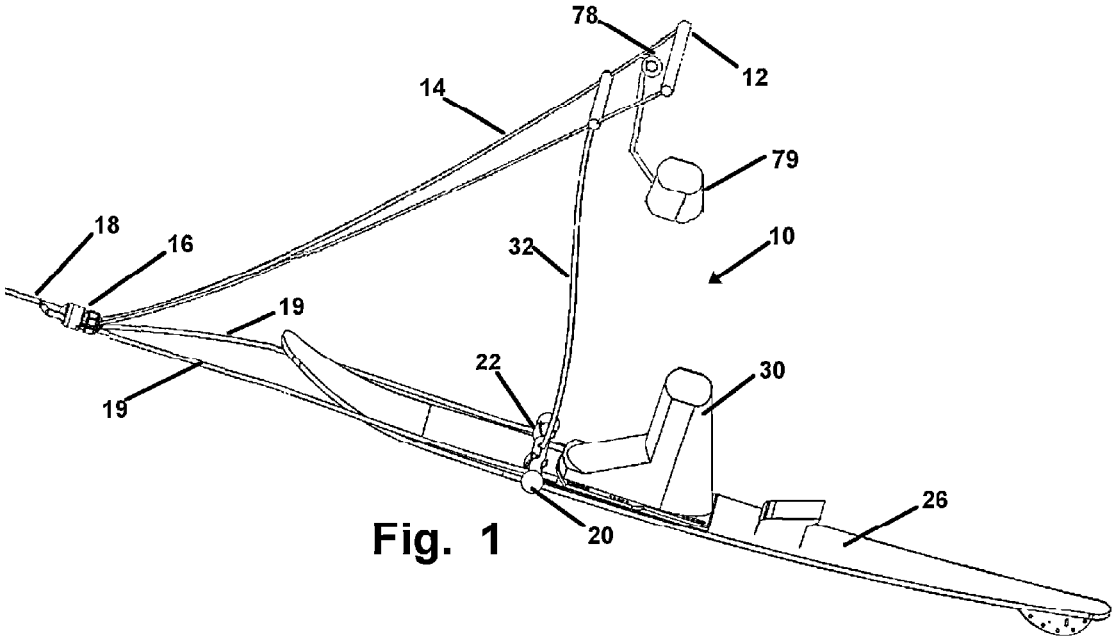
FIG. 1 is a perspective view of one mode of the invention showing the handle on a handle line, the split line engaged to a docking member, and a quick release at a common attachment point for both.
Figure 2:
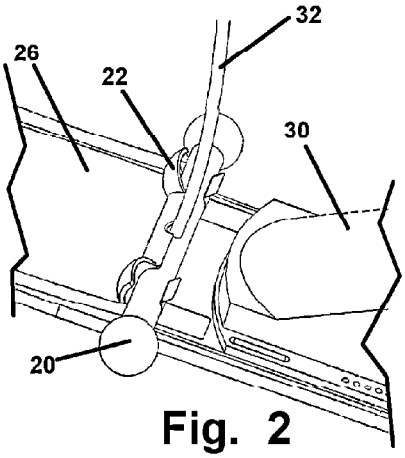
FIG. 2 depicts the biased engagement of the docking member with the docking component which is engaged to the top planar surface of a water ski.

Now referring to drawings in FIGS. 1-29, wherein similar components are identified by like reference numerals, there is seen in FIG. 1 a perspective view of one mode of the device 10 employed for water skiing. As shown, the handle 12 is engaged to the proximal end of a handle line 14 which engages the quick release component 16 which is engaged to the tow rope main line 18 communicating between the quick release component 16 and a boat.

Also engaging at a first end with the quick release component 16 is the split line 19 which is engaged to a docking member 20 at both distal ends of both two portions of the split line 19. The docking member 20 is removably engageable with a docking component 22 which is engaged to the top surface of a water ski 26 just forward of the rubber boot 30 adapted to hold a user's foot to the ski 26. The opposite ends of both portions of the split line 19, are attached to the quick release component 16 using means of attachment thereto such as a knot through an aperture in the quick release component 16.

A release line 32 is engaged to and between the docking member 20 and the handle line 14. The release line 32 is of a length to allow the user to hold onto the handle 12 while in the crouched position of a skier in a deep water start. Once the skier rises to substantially a standing position, the length of the release line 32 causes an upward force, substantially perpendicular in direction to the plane of the top surface of the ski 26, to be exerted on the docking member 20. This force is sufficient to pull the docking member 20 from its biased engagement within the docking component 22 and the inwardly based spring members 23 shown. Thereafter the force from the tow rope is communicated to the handle 12 rather than the docking component 22.

Figure 3:
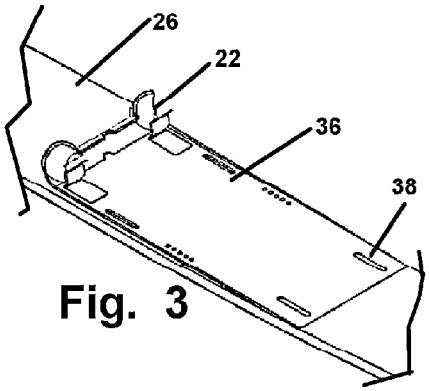
FIG. 3 depicts one mode of a mounting plate adapted to engage upon the top surface of a ski underneath the conventional rubber boot.
Figure 6:
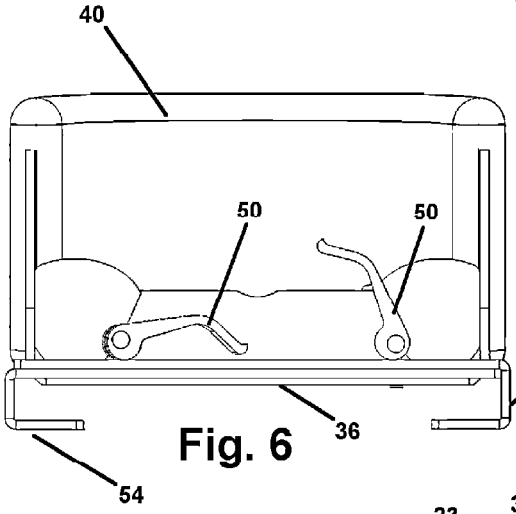
FIG. 6 depicts and end view of the device of FIG. 4 showing the means for clamping the device upon a ski activated by handles having a cam surface.
Figure 5:
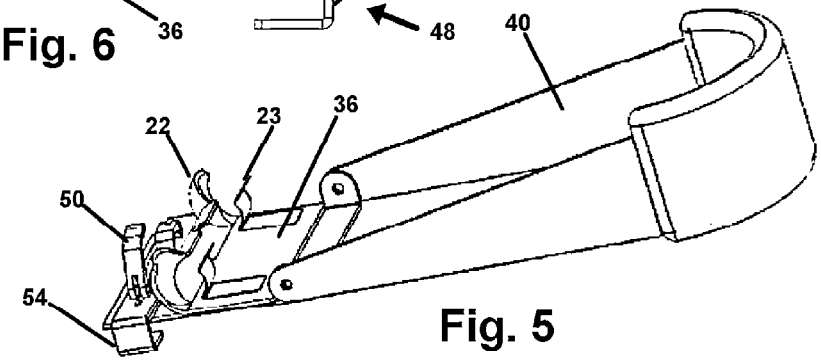
FIG. 5 depicts the mounting plate and components for engagement of the device of FIG. 4.

FIG. 3 shows a mode of engagement of the docking component 22 with the ski 26 as would be typical with a ski 26 having a removable boot 30. A mounting plate 36 is positioned underneath the boot 30 and the screws employed to hold the boot 30 are communicated through slots 38 in the mounting plate 36. Of course those skilled in the art will realize that the means of engagement to the ski 26 of FIG. 3 and of FIG. 5-6, are but two ways to engage the docking component 22 to a water ski 26. As such, any means of engagement of the docking component 22 to a ski 26 as would occur to those skilled in the art, is anticipated within the scope of this application.

Figure 4:
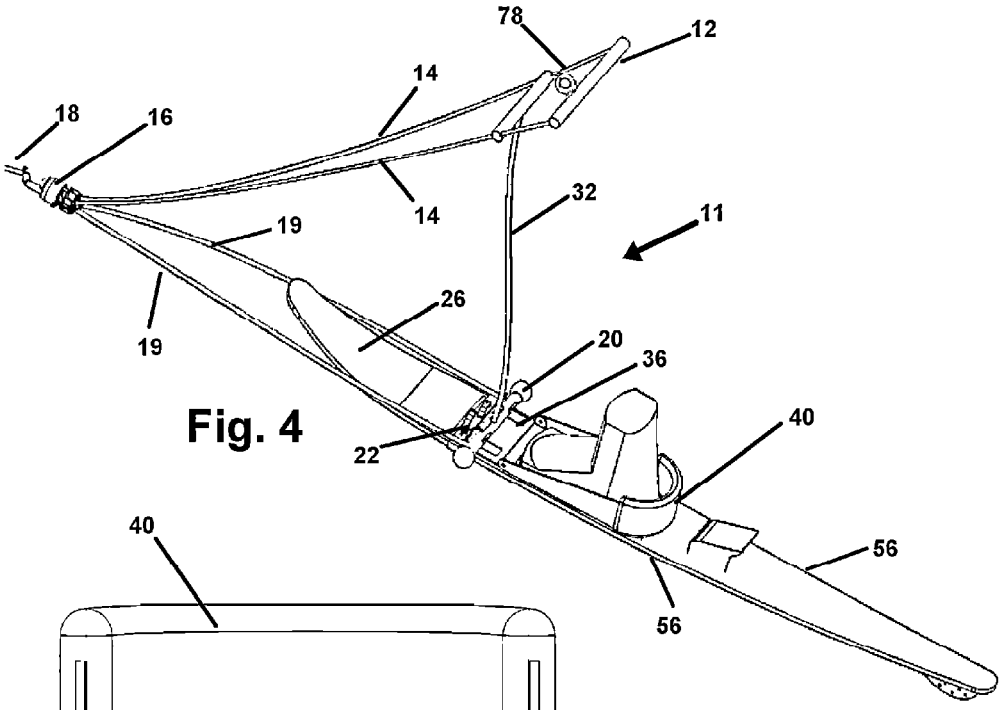
FIG. 4 depicts a perspective view of another mode of the device herein configured for engagement to skis where the boot may not be removed.

FIG. 4 shows a perspective view of another mode of the device 11 herein configured for engagement to skis 26 where the boot 30 may not be removable. In this mode of the device 11 the same configuration and operation of the docking member 20 and docking component 22 are employed. The means of engagement of the docking component 22 to the ski 26 is provided by a clamping component shown in FIG. 6. Additionally, provided to communicate the force of the tow rope to the foot of the skier in the boot 30 is a collar 40 which communicates from the rear of the mounting plate 36 and around the boot 30 engaged to the ski 26.

As shown in FIG. 6, the device of FIGS. 4-6 can be portable and engaged quickly to a ski 26 where the boot 30 is not removable or should there be no desire to remove the boot 30 to mount the docking component 22. A clamping component 48 employs two levers 50 to translate a pair of opposing hook portions 54 toward the outside edges 56 of a ski 26 thereby engaging the docking component 22 to the ski 26. The collar 40 communicates the axial force of the tow rope on the docking component 22 to the rear of the boot 30 and foot of the user thereby minimizing the need for screws or other means to engage the docking component 22 to the ski 26.

Figure 7:
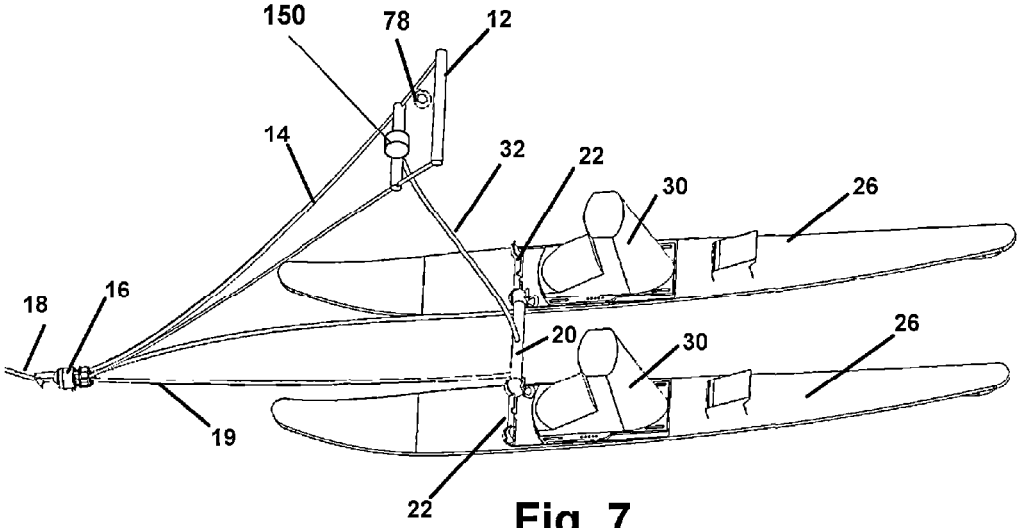
FIG. 7 shows another mode of the device adapted for engagement of the docking member concurrently with two skis having docking components therefor.

Another mode of the device 10 is shown in FIG. 7 which is adapted for engagement to a pair of skis 26. In this mode of the device 10 the docking member 20 engages individual docking components 22 mounted to each ski 26. Operation is the same as the other modes noted earlier. However, in this mode there is shown an optional but preferred spooling line retractor 150. The line retractor 150 is engaged to the release line 32. The line retractor 150 is preferably a spring loaded spooling device which provides a means for biasing the release line 32 towards the handle line 14.

In use, once the docking member 20 is disengaged, a spring loaded spool within the retractor 150 will spool the release line 32 into the retractor 150 until the split line 19 and docking member 20 are substantially inline with the handle line 14. As such, once the user is riding upon the surface of the water, and the docking member 20 is released such that the device 10 is no longer needed, the retractor 150 will bias the docking member 20 and split line 19 up toward the handle line 14 such that the docking component 20 will not drag on the surface of the water, where it may be get caught on a ski or otherwise endanger the user. If the device 10 is needed again, the user will simply pull the release line 32 to unspool it from the line retractor 150 and reposition the device 10 to the as used mode as shown in the figure.

Figure 8:
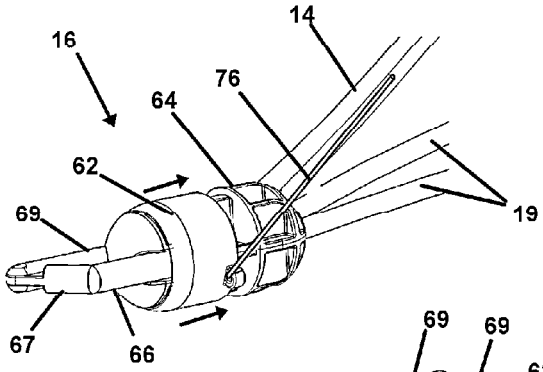
FIG. 8 depicts the quick release device configured for engagement on a first end with the main line of a tow rope leading to the boat, and on a second end with both the split line and handle line.
Figure 10:
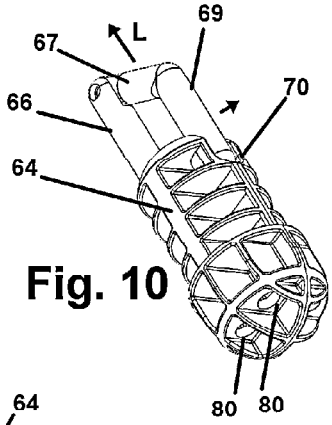
FIG. 10 shows the quick release of FIG. 9 without the locking collar and depicts a direction of the force or load "L" of the main line leading to a tow boat causing rotation of the angled portion of a hinged ring and an immediate release of the quick release from a taught tow rope.
Figure 9:
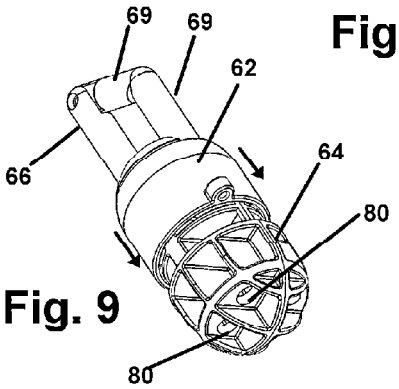
FIG. 9 depicts a translating collar and the direction of translation causing a release of the quick release from a tow rope.

FIGS. 8-10 depict the preferred mode of the novel quick release component 16 which interfaces between the main line 18 the tow rope, and the handle line 14 and the split line 19. The quick release component 16 is configured to provide an immediate separation of the tow rope main line 18 from both the handle line 14 and the split line 19. As shown in FIGS. 8 and 9, a translating collar 62 is situated about the body 64 of the quick release component 16. Translation of the collar 62 moves it away from the ring 66 which engages with the main line 18 of the tow rope leading to the towing boat. Once translated to away from the ring 66 the distal end of the hinged ring 66 is free to rotate away from the body 64 and cause the main line 18 to fall out of engagement with the ring 66. Rotation of the hinged components forming the ring 66 is encouraged by the angled middle portion 67 of the ring and the shorter distal portion 69 which engages with a slot 70 in the body 64. Because the main line 18 is under a force or load "L" during use, should the collar 62 be translated away from the ring end of the body 64, the slot 70 is uncovered. The angled middle portion 67 of the ring 66 is pulled by the main line 18 causing the shorter distal portion 69 to immediately separate from the body 64 and release the main line 18 from the engaged split line 19 and handle line 14.

The user is afforded with a release line 76 which communicates in a conduit to a ring 78 positioned adjacent to the handle 12 or it may be also engaged to a cuff 79 or other means to attach to the user's body while riding. A quick tug of the ring 78 will translate the safety line 76 causing a translation of the collar 62 away from the ring 66 to expose the slot 70 and allow the distal portion 69 to release from the body 64 to release the main line 18. If the cuff 79 or other means of attachment to the body is employed, if the user falls, it will activate the release also. While the device 10 herein will function without the quick release component 16 and such is anticipated, the quick release component 16 does provide for safety of the rider and is preferred. It also provides a plurality of apertures 80 in the body 64 for engaging both the split lines 19 and the handle line 14 thereto.

Figure 11:
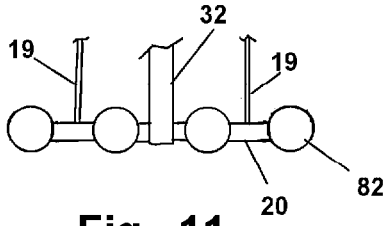
FIG. 11 depicts another preferred mode of the docking member comprising a plurality of substantially spherical biasing members.
Figure 12:
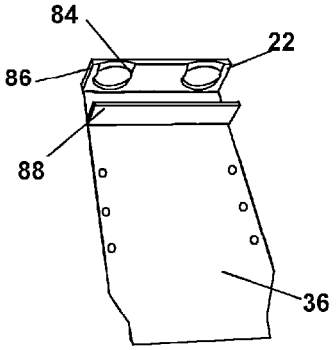
FIG. 12 depicts another preferred mode of the docking component employable with the mode of the docking member shown in FIG. 11.

FIG. 11 and FIG. 12 show further particularly preferred modes of the docking member 20 and docking component 22 of the device 10. In this current mode the docking member 20 comprises a plurality of substantially circular cross section engagement members 82 engaged thereon, preferably formed from a resilient plastic or rubber. The engagement members 82 employed for biased frictional engagement to the docking component 22, however through employment of the release line 32 imparting an upward force, will pull the docking member 20 from its biased engagement within the docking component 22. It is noted that in other preferred mode, the docking member 20 may not include any engagement members 82, and the engagement of the docking member 20 to the docking component 22 may be achieved by the an engagement with the bare bar.

Figure 13:
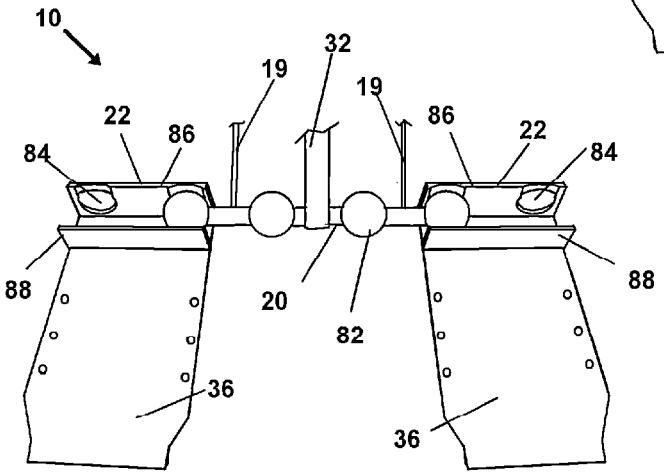
FIG. 13 depicts the biased engagement of the docking member of FIG. 11 with the two of the docking components of FIG. 12 which are engageable to the top planar surfaces of a pair of water skis.
Figure 14:
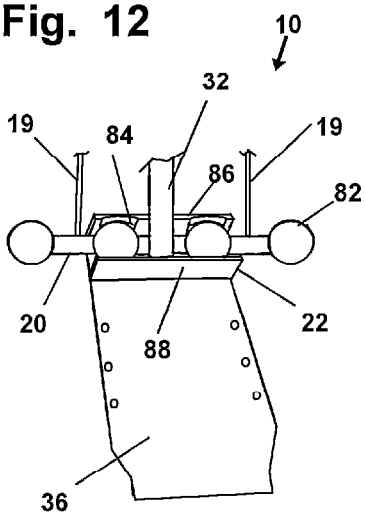
FIG. 14 depicts the biased engagement of the docking member of FIG. 11 with the one the docking components of FIG. 12 which is engageable to the top planar surface of a single water ski.

The docking component 22 includes a first a support surface 86 and a second support surface 88 extending from the mounting plate 36. The support surfaces 86, 88 are spaced a distance preferably slightly less than the diameter of the engagement members 82 in order to receive the engagement members 82 in a sandwiched biased frictional engagement as shown in the as used mode of FIG. 13 employed for a pair of water skis. An interior surface of the at least one of the support surfaces 86, 88 is preferably configured with one or a plurality of recesses 84 employed for registering the engagement members 82 in their biased frictional engagement with the docking component 22. FIG. 13 shows a preferred as used mode of the current modes of the docking member 20 and docking component 22 as would be employed for a pair of water skis (not currently shown). FIG. 14 shows an as used mode of device 10 configured for employment with a single water ski (not shown).

Figure 15:
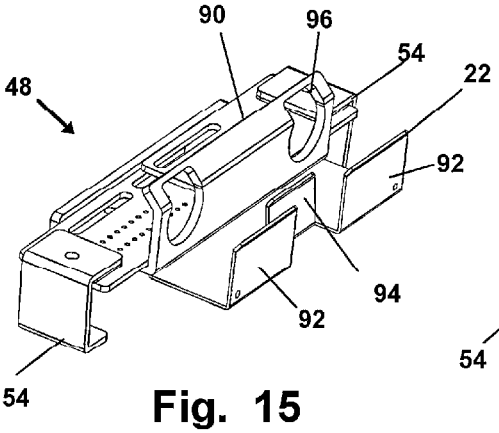
FIG. 15 depicts a first side perspective view of another particularly preferred mode of the docking component employing a means for clamping the device upon a ski activated by handles having a cam surface.
Figure 16:
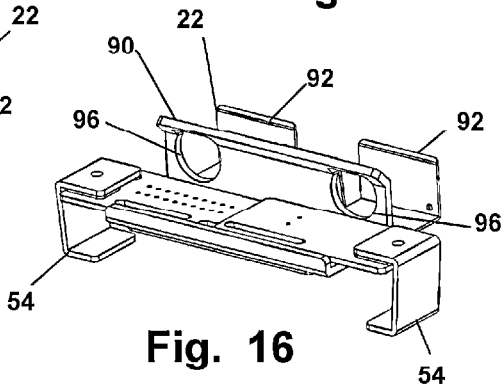
FIG. 16 depicts a second side perspective view of the mode of the docking component of FIG. 15.

FIG. 15 and FIG. 16 show perspective views of yet another mode of the docking component 22 employing a clamping component 48. The clamping component 48 will employ locking levers (not shown) to translate a pair of opposing hook portions 54 toward the outside edges 56 of a ski 26 thereby engaging the docking component 22 to the ski 26. This mode may or may not employ a collar 40 as shown in the previous mode of FIG. 5. The docking component 22 is this mode employs a first support surface 90 and a pair of secondary support surfaces 92 which are employed to engage the engagement members 82 of the docking member 20 in the sandwiched biased engagement shown previously. The first support surface 90 includes a pair of apertures 96 communicating therethrough employed for registering the engagement members 82 in their biased engagement with the docking component 22. A third support surface 94 may be provided to register the engagement of the docking member 20 between adjacent engagement members 82, or to simply engage the docking member 20 in modes without engagement members 83.

Figure 17:
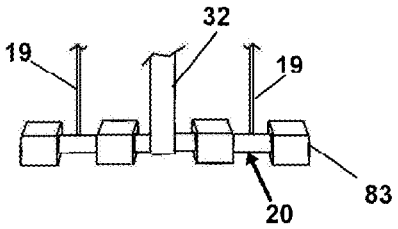
FIG. 17 depicts yet another preferred mode of the docking member comprising a plurality of substantially rectangular cross section biasing members.
Figure 18:
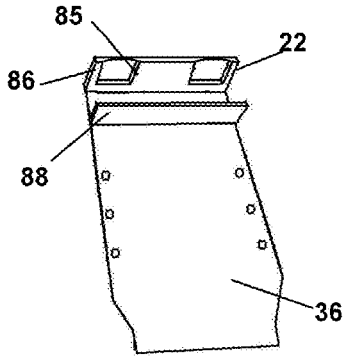
FIG. 18 depicts a preferred mode of the docking component employable with the mode of the docking member shown in FIG. 17.

FIG. 17 and FIG. 18 show further particularly preferred modes of the docking member 20 and docking component 22 of the device 10. In this current mode the docking member 20 comprises a plurality of substantially rectangular cross section engagement members 83 engaged thereon, preferably formed from a resilient plastic or rubber. The engagement members 83 employed for biased frictional engagement to the docking component 22, however through employment of the release line 32 imparting an upward force, will pull the docking member 20 from its biased engagement within the docking component 22.

Similar to the previous mode, the docking component 22 includes a first a support surface 86 and a second support surface 88 extending from the mounting plate 36. The support surfaces 86, 88 are spaced a distance preferably slightly less than the width of the engagement members 83 in order to receive the engagement members 83 in a sandwiched biased frictional engagement. An interior surface of the at least one of the support surfaces 86, 88 is preferably configured with one or a plurality of recesses 84 employed for registering the engagement members 83 in their biased frictional engagement with the docking component 22.

Figure 19:
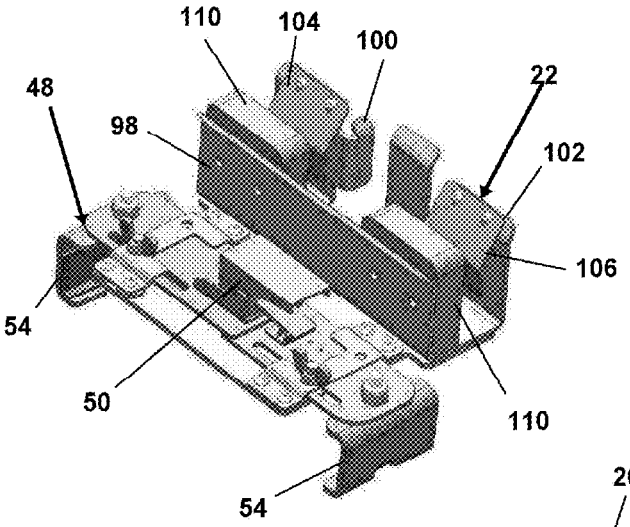
FIG. 19 depicts a first perspective view of yet another particularly preferred mode of the docking component employing a means for clamping the device upon a ski activated by handles having a cam surface.
Figure 20:
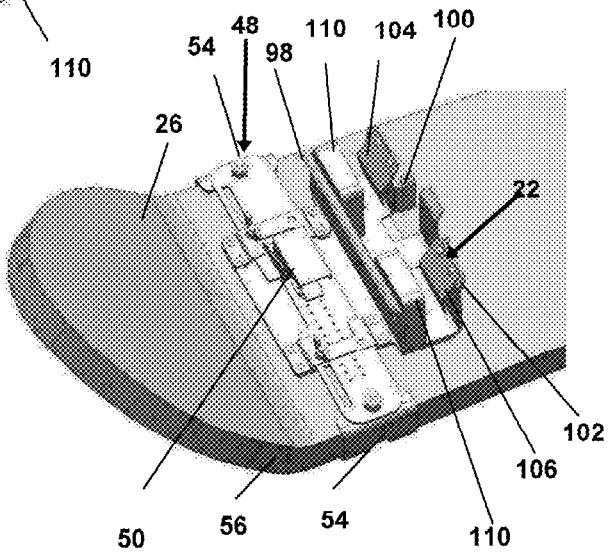
FIG. 20 depicts a second perspective view of the mode of the docking component of FIG. 19 engaged upon a ski.

FIG. 19 and FIG. 20 show perspective views of yet another mode of the docking component 22 employing a clamping component 48. The clamping component 48 employs locking levers 50 to translate a pair of opposing hook portions 54 toward the outside edges 56 of a ski 26 thereby engaging the docking component 22 to the ski 26. The docking component 22 is this mode employs a first support surface 98 and a pair of secondary support surfaces 100, 102 which are employed to engage the engagement members 83 of the docking member 20 in the sandwiched biased engagement. The first support surface 98 includes a pair of engagement pads 110 employed for registering the engagement members 83 in their biased engagement with the docking component 22. A third support surface 108 may be provided to register the engagement of the docking member 20 between adjacent engagement members 83, or to simply engage the docking member 20 in modes without engagement members 83. The pair of secondary support surfaces 100, 102 may additionally employ respective spring members 104, 106 to further bias the docking member 20 in its engagement with the docking component 22.

Figure 21:
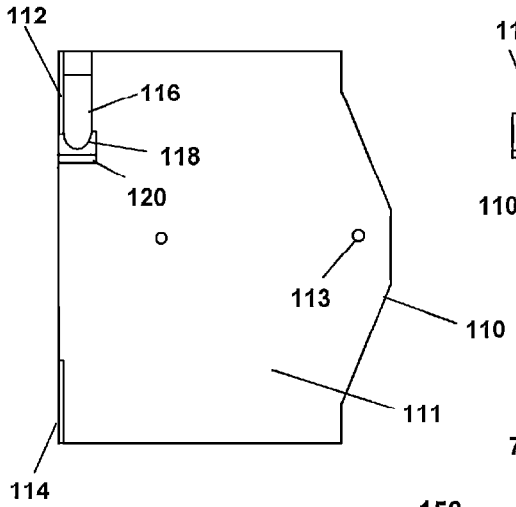
FIG. 21 shows a top view of still yet another particularly mode of the docking component and mounting plate of the invention employed for assisting a user of a wakeboard to achieve a deep water start.
Figure 22:
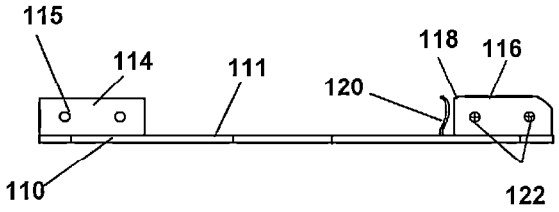
FIG. 22 shows a side view of the mode of the docking component of FIG. 21.

FIG. 21 and FIG. 22 show top and side views respectively of yet another particularly preferred mode the device 10 configured for employment with a wakeboard 128. In wakeboarding deep water starts, the user conventionally sits in the water with the board positioned perpendicular to the direction of travel with their tow side edge positioned at or near the surface of the water. The difficulty in achieving a standing riding position atop the water is the need to both rise to a standing position while simultaneously turning the front foot towards the direction of travel. The current mode of the invention provides a solution by directing the force of the tow rope 18 to the front foot of the user engaged to a wakeboard which will pull the user and board to a riding position atop the surface of the water while additionally rotating the front foot towards the direction of travel.

Figure 23:
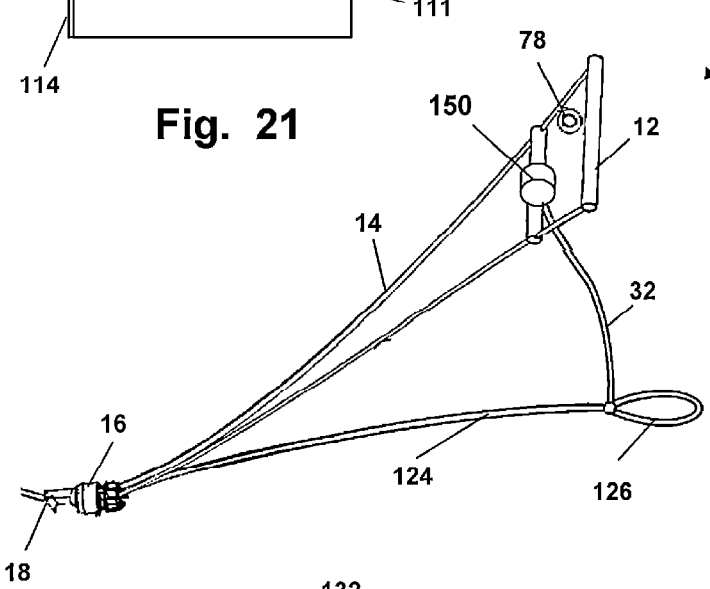
FIG. 23 shows the mode of the device configured for engagement with a wakeboard, showing the handle on a handle line, the single line engaged to a docking member, a quick release at a common attachment point for both, and the docking component engaged upon a wakeboard.
Figure 23:
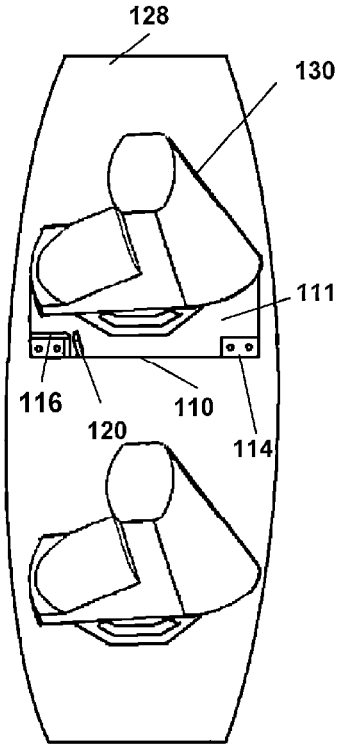

This mode is operatively employed similar to the modes of the device 10 employed for water skis however different configurations of the docking component 110 and docking member 126 are provided. In this mode as shown in FIG. 23, the handle 12 is engaged to the proximal end of a handle line 14 which engages the quick release component 16 which is engaged to the tow rope main line 18 communicating between the quick release component 16 and a boat.

Also engaging at a first end with the quick release component 16 is the single line 124 which is engaged to a docking member 126 at the distal end of the single line 19. The docking member 126 is removably engageable with a docking component 110 which is engaged to the top surface of a wakeboard 128 just inside of one of the boots 130 adapted to hold a user's foot to the wakeboard 128. The docking member 126 of the current mode is preferably provide by forming or otherwise engaging a looped section of rope at or near the engagement of the single line 124 with the release line 32.

It is noted that the docking component 110 of the current mode can be adapted for employment with left or right foot stanced users. The opposite end of the single line 124 is attached to the quick release component 16 using means of attachment thereto such as a knot through an aperture in the quick release component 16.

Similar to previous modes, a release line 32 is engaged to and between the docking member 126 and the handle line 14. Again, the release line 32 is of a length to allow the user to hold onto the handle 12 while in the crouched position of a wakeboarder in a deep water start. Once the rider rises to substantially a standing position, the length of the release line 32 causes an upward force, substantially perpendicular in direction to the plane of the top surface of the wakeboard 128, to be exerted on the docking member 126. This force is sufficient to pull the docking member 126 from its biased engagement within the docking component 110 and the docking mount 116 shown. Thereafter the force from the tow rope is communicated to the handle 12 rather than the docking component 126. The spooling line retractor 150 is also shown employed in this mode.

The docking component 110 comprises a mounting plate 111 which is configured to engaged under the left or right boot 130 of a conventional wakeboard 128. As such the mounting plate may include a plurality of apertures 113 or slots as needed to receive the conventional mounting hardware of the boot 130.

There is included first and second 112, 114 brackets disposed at opposite ends of the mounting plate 111 which are employed to engage the docking mount 116 of the current mode of the wakeboard docking component 110. The brackets 112, 114 include apertures 115 for receiving screws, bolts 122 or the like as needed to engaged the docking mount 116. One skilled in the art will recognize that the choice of positioning the docking mount 116 on either of the brackets 112, 114 will be determined by the dominating foot of the wakeboard user. In FIG. 23 the device is currently shown engaged to the right boot 130, as would be typical for what is referred to as a 'goofy footer'.

Figure 24:
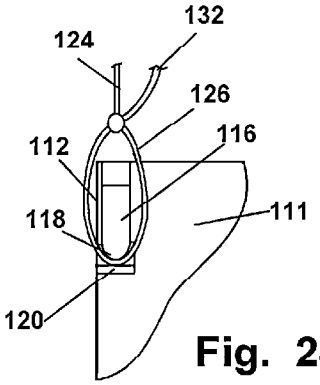
FIG. 24 shows a detailed view of the engagement of the docking member to the docking component.
Figure 25:
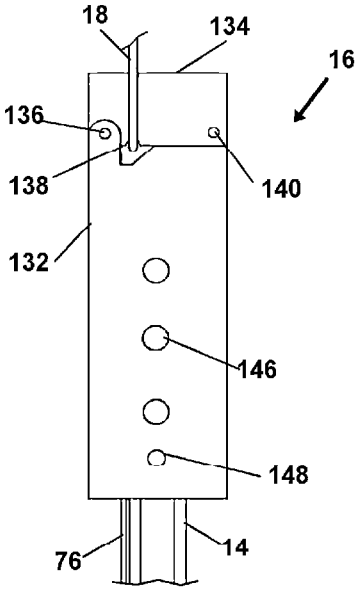
FIG. 25 depicts another particularly preferred mode of the quick release device configured for engagement on a first end with the main line of a tow rope leading to the boat, and on a second end with both the split line (or single line), handle line, and release line.
Figure 26:
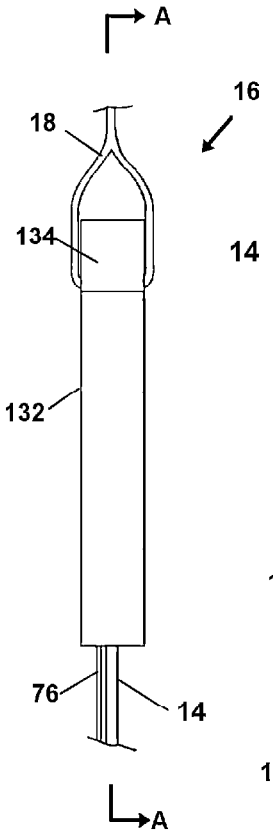
FIG. 26 shows a side view of the mode of the quick release component of FIG. 25.

The docking mount 116 comprises at least one substantially curved edge 118 which is configured to engage the looped section of rope of the docking member 126. This curved edge 118 will reduce frictional wear and tear on the docking member 126 through repeated use. Further a biasing member 120 may be provided to bias the docking member 126 against the curved edge 118 of the docking mount 116. This will insure the docking member 126 does not inadvertently disengage prior to the deep water start. However, similar to previous modes, it is the intent of the invention that the docking member 126 can be disengaged from the biased engagement with the docking mount 116 through a vertical force imparted by a pulling of the release line 32 once the user has achieved the riding position. FIG. 24 shows a top view of the docking member 126 in the as used biased engagement with the docking mount 116 of the docking component 110.

FIGS. 25-29 show views of another particularly preferred mode of the quick release 16 which interfaces between the main line 18 of the tow rope, and the handle line 14, split line 19 (or single line 124), and release line 76. Again, the quick release component 16 is configured to provide an immediate separation of the tow rope main line 18 from both the handle line 14 and the split line 19 (or single line 124). In this mode the quick release 16 is comprised of a main body 132 and rotatable engage lid portion 134. The body 132 and lid 134 are preferably formed from portions of metal rectangular cross section tubing however can be formed of any material suitable for the intended purpose.

Figure 27:
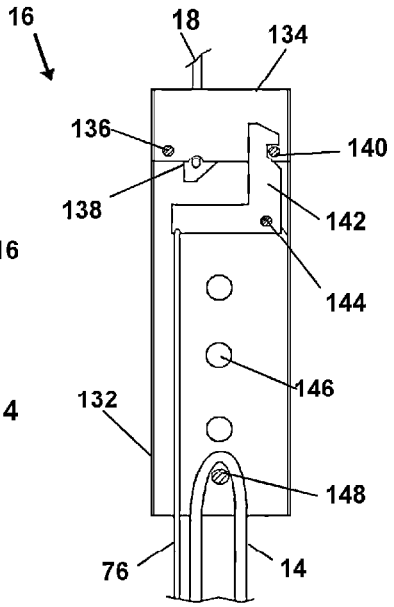
FIG. 27 shows a cross sectional view of the quick release component of FIG. 25 along line AA of FIG. 26, depicting the engagement with main tow line, handle line, and release line.

FIG. 27 shows a cross sectional view of the quick release 16 in a locked configuration showing the lid 134 rotatable engaged to the bode 132 by a hinge 136. There is additionally employed a locking pin 140 engaged to and communicating through the lid 134 provided for releasable locking engagement with a latch 142. In use, the distal end of the main tow line 18 is engaged to the lid 134 such that a locking of the lid 134 securely engages the tow line 18 thereon. A notch 138 may be provided to as a means for registered engagement of the tow line 18 to the lid portion 134. As is shown the distal end of the tow line 18 can be formed in a loop to easily engage about the lid 134. At the other end of the quick release 16, opposite the lid 134, the handle line 14 is in an engagement with an additional pin 148, or bolt engaged to the body 132 and extends therefrom to the handle end 12. The body 132 of the quick release 16 additionally includes one or a plurality of apertures 146 communicating therethrough which are provided as a means for engaging the split line 19 (or single line 124), not currently shown. In use the distal end of the split line 19 (or single line 124) can be woven or strung through the apertures 146 and tied or otherwise secured to provide engagement thereto.

Figure 28:
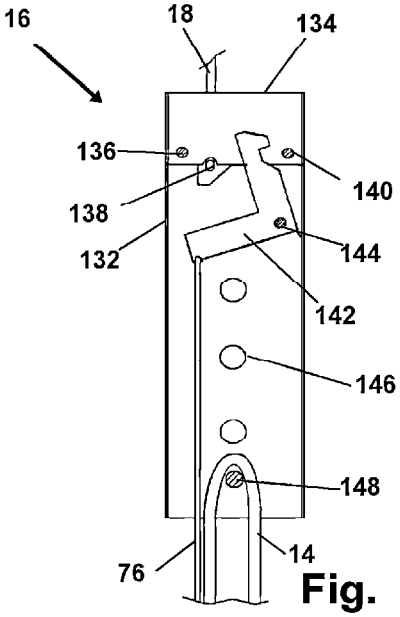
FIG. 28 shows a cross sectional view of the quick release component depicting a rotating latch causing a release of the quick release from a tow rope.
Figure 29:
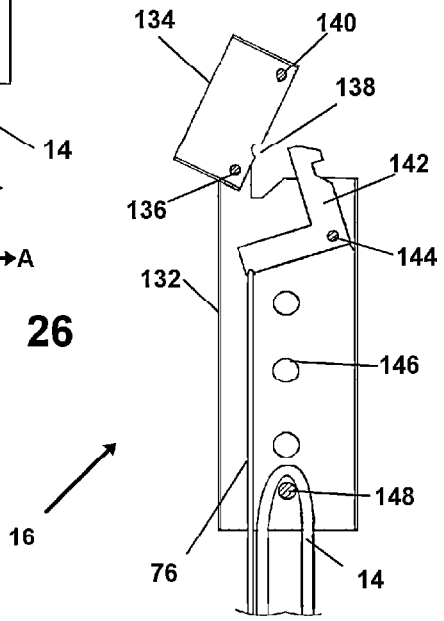
FIG. 29 shows a cross sectional view depicting the resulting disengagement of the tow rope.

The release line 76 is shown extending from an engagement with the distal end of the latch 142 to a communication along the handle line 14. The latch 142 is rotatable engaged to the body 134 of the quick release 16 by a spring loaded hinged 144 employed to bias the latch 142 to the locked position of FIG. 27. However, as shown in FIG. 28, when the user pulls the release line 76, the latch 142 is rotated about the hinge 144 and is disengaged from its engagement with the locking pin 140 of the lid 134. As such the lid 134 is now free to rotate open (FIG. 29) and provide an immediate separation of the quick release 16 from the main line 18.

While all of the fundamental characteristics and features of the towing rope device herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A tow rope engagement apparatus for employment with water sports equipment for supporting a standing rider being towed through water, comprising;

a handle;

a handle line engaged at a first end to said handle and extending to a second end;

said handle configured for gripping by a hand of user riding said sports equipment;

a docking member, said docking member dimensioned for a removable engagement in an engaged position with a docking component, said docking component having a base plate engageable to a riding surface of said sports equipment, a pair of sidewalls rising from said baseplate and a space between said sidewalls configured for a frictional engagement with said docking member;

a split line engaged at a first end to said docking member and extending to a distal end;

means to engage said distal end of said split line, and said second end of said handle line, to a distal end of a tow rope configured to engage with an aquatic towing vehicle;

said docking member being disengageable from said engaged position with said docking component by movement in a direction substantially normal to said riding surface;

a release line communicating between said handle line and said docking member; and said release line providing means for communicating a force to said docking member to induce a movement toward said vertical direction and a disengagement from said engaged position, when said rider of said sports equipment moves from a crouched position, adjacent to said riding surface during the start of a tow of said body, to a substantially standing position upon said riding surface;

whereby force from said towing vehicle communicated to said tow rope during said start of said tow, with said docking member in said engaged position, is communicated primarily to said sports equipment, whereafter said force is communicated primarily to said handle subsequent to said user moving from a said crouched position to said standing position.

2. The tow rope engagement apparatus of claim 1 additionally comprising:

at least one of said sidewalls formed of a resilient material;

said space between said sidewalls being smaller than a diameter of said docking member; and a compression of said sidewalls exerting a bias against said docking member when in said engaged position within said docking component.

3. The tow rope engagement apparatus of claim 2 wherein said means to engage said distal end of said split line and said second end of said handle line to one end of a tow rope comprises:

a release component having a body and a rotatably engaged lid, a first end of said body, opposite said lid, having means for engagement with said distal end of said split line and said second end of said handle line;

a latch, said latch rotationally engaged to said body at an opposite end from said first end;

said latch configured for an engagement of said lid in a locked position;

said latch rotatable between a closed position wherein said tow rope is engaged to said lid in said locked position, to an open position wherein said tow rope will disengage from said lid when said latch is disengaged from said lid; and means for said user to cause said latch to move to said open position, whereby said tow rope can be released from said lid ending communication of said force to said sports equipment.

4. The tow rope engagement apparatus of claim 2 additionally comprising:

said sports equipment being one or a pair of waters skis;

at least one of said pair of sidewalls having means for registered engagement with said docking member;

said docking member being an elongated bar having one or a plurality of engagement members configured for said registered engagement with said docking component.

5. The tow rope engagement apparatus of claim 2 additionally comprising:

said sports equipment being a wakeboard;

said docking member being a loop formed by a portion of rope;

said docking component comprising at least one mount configured to engage said loop during said start; and whereby said loop is disengageable from said mount after said user achieves said substantially standing position.

6. The tow rope engagement apparatus of claim 3 wherein said means for said user to cause said latch to move to said open position comprises:

a release line engaged at a first end to said latch;

a second end of said release line engaged at or near said handle;

whereby a tug on said release line causes a rotation of said latch to said open position.

7. The tow rope engagement apparatus of claim 3 additionally comprising:

said sports equipment being one or a pair of waters skis;

at least one of said pair of sidewalls having means for registered engagement with said docking member;

said docking member being an elongated bar having one or a plurality of engagement members configured for said registered engagement with said docking component.

8. The tow rope engagement apparatus of claim 3 additionally comprising:

said sports equipment being a wakeboard;

said docking member being a loop formed by a portion of rope;

said docking component comprising at least one mount configured to engage said loop during said start; and whereby said loop is disengageable from said mount after said user achieves said substantially standing position.

9. The tow rope engagement apparatus of claim 6 additionally comprising:

means to attach said second end of said release line to the person of said user, whereby said tug is exerted upon said release line should said user fall during a ride on said sports equipment.

10. The tow rope engagement apparatus of claim 6 additionally comprising:

said sports equipment being one or a pair of waters skis;

at least one of said pair of sidewalls having means for registered engagement with said docking member;

said docking member being an elongated bar having one or a plurality of engagement members configured for said registered engagement with said docking component.

11. The tow rope engagement apparatus of claim 6 additionally comprising:

said sports equipment being a wakeboard;

said docking member being a loop formed by a portion of rope;

said docking component comprising at least one mount configured to engage said loop during said start; and whereby said loop is disengageable from said mount after said user achieves said substantially standing position.

12. The tow rope engagement apparatus of claim 9 additionally comprising:

said sports equipment being one or a pair of waters skis;

at least one of said pair of sidewalls having means for registered engagement with said docking member;

said docking member being an elongated bar having one or a plurality of engagement members configured for said registered engagement with said docking component.

13. The tow rope engagement apparatus of claim 9 additionally comprising:

said sports equipment being a wakeboard;

said docking member being a loop formed by a portion of rope;

said docking component comprising at least one mount configured to engage said loop during said start; and whereby said loop is disengageable from said mount after said user achieves said substantially standing position.

14. The tow rope engagement apparatus of claim 1 wherein said means to engage said distal end of said split line and said second end of said handle line to one end of a tow rope comprises:

a release component having a body and a rotatably engaged lid, a first end of said body, opposite said lid, having means for engagement with said distal end of said split line and said second end of said handle line;

a latch, said latch rotationally engaged to said body at an opposite end from said first end;

said latch configured for an engagement of said lid in a locked position;

said latch rotatable between a closed position wherein said tow rope is engaged to said lid in said locked position, to an open position wherein said tow rope will disengage from said lid when said latch is disengaged from said lid; and means for said user to cause said latch to move to said open position, whereby said tow rope can be released from said lid ending communication of said force to said sports equipment.

15. The tow rope engagement apparatus of claim 14 wherein said means for said user to cause said latch to move to said open position comprises:

a release line engaged at a first end to said latch;

a second end of said release line engaged at or near said handle;

whereby a tug on said release line causes a rotation of said latch to said open position.

16. The tow rope engagement apparatus of claim 15 additionally comprising:

means to attach said second end of said release line to the person of said user, whereby said tug is exerted upon said release line should said user fall during a ride on said sports equipment.

17. The tow rope engagement apparatus of claim 1 additionally comprising:

said sports equipment being one or a pair of waters skis;

said docking member being an elongated bar configured for an engagement with said docking component.

18. The tow rope engagement apparatus of claim 1 additionally comprising:

said sports equipment being one or a pair of waters skis;

at least one of said pair of sidewalls having means for registered engagement with said docking member;

said docking member being an elongated bar having one or a plurality of engagement members configured for said registered engagement with said docking component.

19. The tow rope engagement apparatus of claim 1 additionally comprising:

said sports equipment being a wakeboard;

said docking member being a loop formed by a portion of rope;

said docking component comprising at least one mount configured to engage said loop during said start; and whereby said loop is disengageable from said mount after said user achieves said substantially standing position.

20. A tow rope engagement apparatus for employment with water sports equipment for supporting a standing rider being towed through water, comprising;

a handle;

a handle line engaged at a first end to said handle and extending to a second end;

said handle configured for gripping by a hand of user riding said sports equipment;

a docking member, said docking member dimensioned for a removable engagement in an engaged position with a docking component, said docking component adapted for an engagement upon a riding surface of a body of said sports equipment;

a docking rope engaged at a first end to said docking member and extending to a distal end;

a release component having a body and a rotatably engaged lid;

a first end of said body, opposite said lid, having means for engagement with said distal end of said split line and with said second end of said handle line;

a latch, said latch rotationally engaged to said body at an opposite end from said first end;

said latch configured for an engagement of said lid in a locked position;

said latch rotatable between a closed position wherein said tow rope is engaged to said lid in said locked position, to an open position wherein said tow rope will disengage from said lid when said latch is disengaged from said lid; and means for said user to cause said latch to move to said open position, whereby said tow rope can be released from said lid ending communication of said force to said sports equipment;

said docking member being disengageable from said engaged position with said docking component by movement in a direction substantially normal to said riding surface;

a release line communicating between said handle line and said docking member; and said release line providing means for communicating a force to said docking member to induce a movement toward said vertical direction and a disengagement from said engaged position, when said rider of said sports equipment moves from a crouched position, adjacent to said riding surface during the start of a tow of said body, to a substantially standing position upon said riding surface;

whereby force from said towing vehicle communicated to said tow rope during said start of said tow, with said docking member in said engaged position, is communicated primarily to said sports equipment, whereafter said force is communicated primarily to said handle subsequent to said user moving from a said crouched position to said standing position.

21. The tow rope engagement apparatus of claim 20 wherein said means for said user to cause said latch to move to said open position comprises:

a release line engaged at a first end to said latch;

a second end of said release line engaged at or near said handle;

whereby a tug on said release line causes a rotation of said latch to said open position.

22. The tow rope engagement apparatus of claim 20 additionally comprising:

said sports equipment being a wakeboard;

said docking member being a loop formed by a portion of rope;

said docking component comprising at least one mount configured to engage said loop during said start; and whereby said loop is disengageable from said mount after said user achieves said substantially standing position.

23. The tow rope engagement apparatus of claim 21 additionally comprising:

means to attach said second end of said release line to the person of said user, whereby said tug is exerted upon said release line should said user fall during a ride on said sports equipment.

* * * * *